US011273480B2

(12) United States Patent
Hofer et al.

(10) Patent No.: US 11,273,480 B2
(45) Date of Patent: Mar. 15, 2022

(54) TRANSPORT DEVICE AND METHOD FOR TRANSPORTING A COIL

(71) Applicant: Primetals Technologies Austria GmbH, Linz (AT)

(72) Inventors: Roland Hofer, Reichenau im Muehlkreis (AT); Christoph Salzmann, Linz (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 301 days.

(21) Appl. No.: 16/483,173

(22) PCT Filed: Feb. 22, 2018

(86) PCT No.: PCT/EP2018/054378
§ 371 (c)(1),
(2) Date: Aug. 2, 2019

(87) PCT Pub. No.: WO2018/153982
PCT Pub. Date: Aug. 30, 2018

(65) Prior Publication Data

US 2020/0230676 A1 Jul. 23, 2020

(30) Foreign Application Priority Data

Feb. 22, 2017 (EP) ..... 17157294

(51) Int. Cl.
*B21C 47/24* (2006.01)

(52) U.S. Cl.
CPC ..... *B21C 47/24* (2013.01)

(58) Field of Classification Search
CPC ..... B21C 47/24; B21C 47/28; B21C 47/242; B21C 47/245; B65B 27/06;
(Continued)

(56) References Cited

U.S. PATENT DOCUMENTS 2,198,644 A * 4/1940 Wettengel ..... B21C 47/242 242/533.3
2,981,429 A * 4/1961 Williamson ..... B62B 3/0612 414/622

(Continued)

FOREIGN PATENT DOCUMENTS

CN 104923584 A 9/2015
DE 10 2011 080 410 A1 6/2012

(Continued)

OTHER PUBLICATIONS

International Search Report dated May 9, 2018 in corresponding PCT International Application No. PCT/EP2018/054378.

(Continued)

*Primary Examiner* — Gregory W Adams
(74) *Attorney, Agent, or Firm* — Ostrolenk Faber LLP

(57) ABSTRACT

A transport device (2, 50, 56, 88) for transporting a coil (4), comprising a coil transport cart (6) having a chassis (8) and having a coil support (10), which is height-adjustable relative to the chassis (8). In order to enable secure transport of the coil (4), the transport device (2, 50, 56, 88) has a movable fastening device (12) having a clamping unit (22) for pressing the coil (4) to be transported against the coil support (10). The clamping unit (22) being height-adjustable relative to the coil support (10) and being able to be at least partly inserted into a coil eye (42) of the coil (4). The fastening device (12) being fastened to the coil support (10) or to the chassis (8) of the coil transport cart (6). The coil support (10) having a cut-out (40), into which the clamping unit (22) can be at least partly lowered. Further disclosed is a use of such a transport device (2, 50, 56, 88), to a coil-processing system (70, 118) having such a transport device (2, 50, 56, 88), and to a method for transporting a coil (4).

13 Claims, 12 Drawing Sheets

(58) Field of Classification Search
CPC ..... Y10S 414/121; Y10S 414/123; Y10S 414/124; B65H 19/30
USPC ... 242/361.3, 361.5, 403, 559, 559.3, 596.7, 242/599; 294/67.2, 67.21, 67.22; 414/281, 282, 622, 910, 911
See application file for complete search history.

(56) References Cited

U.S. PATENT DOCUMENTS

| | | | | |
|---|---|---|---|---|
| 4,056,186 | A * | 11/1977 | Hill | B21C 47/24 100/12 |
| 4,657,196 | A * | 4/1987 | Irish | B21C 47/16 242/540 |
| 4,898,336 | A | 2/1990 | Reist | 242/59 |
| 5,158,242 | A | 10/1992 | Honegger | 242/59 |
| 5,372,469 | A | 12/1994 | Kobayashi | 414/543 |
| 5,706,692 | A * | 1/1998 | Chubb | B21D 5/04 242/595.1 |
| 6,290,164 | B1 | 9/2001 | O'Connor | 242/471 |
| 6,412,730 | B1 | 7/2002 | Shimazaki | 242/602 |
| 6,679,451 | B1 | 1/2004 | Biagiotti | 242/559 |
| 9,289,809 | B2 | 3/2016 | Cramer | |
| 2004/0050988 | A1 | 3/2004 | O'Connor | 242/160.4 |
| 2013/0256439 | A1 | 10/2013 | Cramer et al. | 242/363 |

FOREIGN PATENT DOCUMENTS

| | | | |
|---|---|---|---|
| EP | 0744372 | A2 | 11/1996 |
| JP | S51-37862 | A | 3/1976 |
| JP | S54-116361 | A | 9/1979 |
| JP | S54-152134 | U | 10/1979 |
| JP | S59-106617 | A | 6/1984 |
| JP | S63-84727 | A | 4/1988 |
| JP | S63-168224 | U | 11/1988 |
| JP | H03-085106 | U | 8/1991 |
| JP | H03-193215 | A | 8/1991 |
| JP | H07-2220 | A | 1/1995 |
| JP | H07-025525 | A | 1/1995 |
| JP | H07-088551 | A | 4/1995 |
| JP | 2007-044747 | A | 2/2007 |
| JP | 2011-020761 | A | 2/2011 |
| JP | 2014-504212 | A | 2/2014 |
| RU | 2338612 | C1 | 11/2008 |
| SU | 1007779 | A1 | 3/1983 |

OTHER PUBLICATIONS

Written Opinion dated May 9, 2018 in corresponding PCT International Application No. PCT/EP2018/054378.
Extended European Search Report dated Sep. 15, 2017 in corresponding European Patent Application No. 17157294.4.
Japanese Office Action, dated Nov. 2, 2020, issued in corresponding Japanese Patent Application No. 2019-545765. English translation. Total 10 pages.
Russian Federation Notice of Allowance, dated Jun. 1, 2021, issued in corresponding Russian Patent Application No. 2019126630/05(052203). Total 11 pages.
European Third Party Observation for Application No. EP20180705420, dated Oct. 28, 2020, issued in corresponding European Patent Application No. EP18705420.0. Total 6 pages.
European Third Party Observation for Application No. EP20180705420, dated Oct. 28, 2020, issued in corresponding European Patent Application No. EP18705420.0. Total 3 pages.

* cited by examiner

TRANSPORT DEVICE AND METHOD FOR TRANSPORTING A COIL

CROSS-REFERENCE TO RELATED APPLICATIONS

The present application is a 35 U.S.C. §§ 371 national phase conversion of PCT/EP2018/054378, filed Feb. 22, 2018, the contents of which are incorporated herein by reference which claims priority of European Patent Application No. 17157294.4, filed Feb. 22, 2017, the contents of which are incorporated by reference herein. The PCT International Application was published in the German language.

FIELD OF THE INVENTION

The invention relates to a transport device for transporting a coil, a use of such a transport device, a coil processing system with such a transport device and a method for transporting a coil.

BACKGROUND OF THE INVENTION

In the metal industry, it is customary to transport a rolled product, such as a metal strip or a metal wire, as a bundle, i.e., wound up. Such a bundle of wound-up rolled product is also called a coil in technical circles.

For the transport of a coil, one may use a coil transport cart, for example, which is fitted with a coil support on which the coil can be placed.

A coil in which the wound-up rolled product has high strength and/or large thickness may have a tendency to bounce up from a coil support of a coil transport cart or to fall down from the coil support, since the coil acts like a spiral spring on account of its material stiffness. The bouncing of a coil carries the risk of injuring persons in the vicinity of the coil and/or damaging equipment components.

In order to hinder bouncing of a coil, especially during its transport, after the rolled product is wound up, the coil can be closed with one or more strapping bands.

Moreover, it is known how to take a sample from a coil in a sampling station in order to monitor its quality.

For purposes of the sampling, the coil is usually partly unwound in the sampling station. Any strapping bands which are present must be first removed. After the sampling, the remaining coil is completely wound up and typically closed again with one or more strapping bands.

If any strapping bands that are present are removed in a separate band removal station located upstream from the sampling station, there is a danger that a coil with a tendency to bounce up will bounce up during its transport from the band removal station to the sampling station. Likewise, if a coil with a tendency to bounce is again strapped in a strapping station located downstream from the sampling station, the coil may bounce under certain circumstances during its transport from the sampling station to the strapping station.

Furthermore, in the case of a coil having a narrow width and a large diameter and which is transported in such a way, resting on a coil transport cart, that its coil axis is oriented horizontally during the transport, there is a high danger that the coil will tip over during the transport, especially when it starts to move and/or when the coil transport cart is braked. The transport of such narrow coils with large diameters thus likewise carries the risk of persons being injured in the vicinity of the coil and/or equipment components getting damaged.

DE 10 2011 080 410 A1 discloses a transport device for transporting of a coil, wherein the device has a coil transport cart and a height-adjustable coil support. A movable fastening device provides a height-adjustable clamping unit for pressing the coil to be transported against the coil support, and the clamping unit can be introduced at least partly into a coil eye of the coil.

SUMMARY OF THE INVENTION

An object of the invention is to enable safe transport of a coil.

This object is achieved according to the invention by a transport device disclosed herein, by a coil processing system disclosed herein, by the use disclosed herein and by a method disclosed herein.

The transport device according to the invention for transporting a coil comprises a coil transport cart. The coil transport cart has a chassis and has a coil support, which is height-adjustable relative to the chassis. Furthermore, the transport device according to the invention comprises a movable fastening device having a clamping unit for pressing the coil to be transported against the coil support. The clamping unit is height-adjustable relative to the coil support and is able to be at least partly inserted into a coil eye of the coil.

With the aid of the coil transport cart, a coil to be transported can be driven from one location to another, by the coil lying on the coil support of the coil transport cart.

The movable fastening device, and especially its clamping unit, can be used to secure the coil during its transport with respect to the coil support, i.e., to hold the coil firmly in its position with respect to the coil support.

Pressing of the coil to be transported against the coil support with the aid of the clamping unit makes it possible to form a force locking between the coil and the coil support.

By pressing the coil to be transported against the coil support, the coil can be reliably protected against tipping over and/or against bouncing. The transport device can thus be used in particular to transport coils with a tendency to bounce and/or tip over, although the transport device is not limited to the transport of such coils.

Furthermore, the transport device is not limited to the transport of coils of a predetermined diameter, but rather it can transport coils of different diameters.

Because a coil to be transported can be secured relative to the coil support with the aid of the clamping unit, it is moreover not necessary for the coil to be closed using one or more strapping bands during its transport on the coil transport cart, especially even if the coil has a tendency to bounce.

With the aid of the clamping unit it is furthermore possible at a coil processing station to press the coil against a coil receiver of the coil processing station. This enables safe processing of the coil in/at the coil processing station, especially also when the coil has a tendency to bounce and is not strapped with a strapping band.

The coil transport cart is preferably a railway car and the coil transport cart can preferably travel on rails.

Advantageously, the coil transport cart is outfitted with wheels on which the coil transport cart can travel. It is further advantageous for the coil transport cart to have a drive unit, especially an electric motor, for the driving its wheels.

According to one preferred embodiment of the invention, the coil transport cart is outfitted with a drive unit for driving the coil support, especially for raising and lowering the coil support. This drive unit may be a lift cylinder, for example, especially a hydraulic lift cylinder. Hydraulic lift cylinders have the advantage of being generally compact and robust.

Moreover, it is advantageous for the fastening device to have its own drive unit for driving the clamping unit, especially for raising and lowering the clamping unit. This drive unit may be, for example, a lift cylinder, especially a hydraulic lift cylinder.

In a preferred manner, the clamping unit can move in a linear fashion. The coil transport cart for example may have a guide element, especially a sliding guide, by which the clamping unit is mounted in a linearly movable manner relative to the coil support of the coil transport cart. Such a guide element may for example be part of the coil support or the chassis or be fastened to the coil support or the chassis.

Furthermore, it is basically possible for the clamping unit to be movable by swiveling. In particular, the clamping unit may have mutually swiveling sections.

The fastening device, especially its drive unit for driving the clamping unit, is fastened to the coil support or to the chassis of the coil transport cart. This allows a compact design of the transport device, since in this case, a separate cart for the fastening device and the synchronization device can be omitted. Thus, the traveling ability of the fastening device can be assured in particular by the traveling ability of the coil transport cart.

If the fastening device is secured to the chassis of the coil transport cart, the transport device preferably comprises a synchronization device for synchronizing the movements of the clamping unit and the coil support. This synchronization device is advantageously designed to actuate the drive unit for driving the clamping unit and the drive unit for driving the coil support in such a way that the coil support and the clamping unit move synchronously, i.e., at the same rate of speed and in the same direction of movement. For monitoring the positions of the clamping unit and/or the coil support, the synchronization device may have one or more position sensors.

If the fastening device is secured to the coil support, during the raising/lowering of the coil support, the clamping unit preferably moves by the same height as the coil support, insofar as the clamping unit is not being raised/lowered by the drive unit of the fastening device relative to the coil support. In this case, no synchronization device is needed in principle to synchronize the movements of the clamping unit and the coil support.

In one preferred embodiment of the invention, the clamping unit has a clamping section and a base section joined to the clamping section. The clamping section in particular may be formed as a single piece with the base section. Moreover, the clamping section and the base section are preferably oriented perpendicular to each other. Moreover, the clamping section preferably extends in the longitudinal direction of the coil support.

The aforementioned drive unit of the fastening device may be integrated at least partly in the clamping unit, especially in the base section of the clamping unit.

The clamping unit can be at least partly lowered in the coil support, especially at least part of its clamping section. The clamping unit may be lowered in the coil support particularly when pressing of the coil to be transported against the coil support is not required, for example, because the coil has no tendency to bounce or to tip over. In such a case, introducing the clamping unit into a coil eye of the coil to be transported or pressing of the coil against the coil support are not necessary, which can make the overall coil transport more time-efficient.

The coil support has a cut-out, in which the clamping unit can be at least partly lowered. It is especially preferable for the clamping unit to be able to be lowered in the coil support such that its top side is flush with the top side of the coil support.

In one advantageous embodiment of the invention, the clamping unit is outfitted with a friction reducing unit. Advantageously, the friction reducing unit serves for reducing frictional resistance between the coil and the clamping unit, especially when winding and/or unwinding the coil. The friction reducing unit may comprise for example one or more rollers as friction reducing means. Advantageously, the rollers are rotatably mounted.

Preferably, the friction reducing unit is situated on the bottom side of the clamping section of the clamping unit, in particular, at that end of the clamping section which is at a distance from the base section of the clamping unit.

Moreover, the clamping unit may have a rounded pressing surface for pressing against the coil eye. By the rounding of the pressing surface of the clamping unit, its pressing force can act on a larger area of the coil to be transported (as compared to a flat pressing surface). In this way, damage to the coil by the clamping unit, such as in the form of indentations, can be avoided or at least reduced.

In a preferred manner, the rounded pressing surface is situated on the bottom side of the clamping section of the clamping unit, especially at that end of the clamping section which is at a distance from the base section of the clamping unit.

Furthermore, the coil support may comprise multiple bearing tines, on which the coil can be placed. It is advantageous for the bearing tines to be beveled toward the longitudinal center plane of the coil support. In this way, the bearing tines can stabilize the coil to be transported on the coil support.

By the longitudinal center plane of the coil support is meant a plane parallel to the longitudinal direction of the coil support, relative to which the coil support is formed in mirror symmetry. The wording that "the bearing tines are beveled toward the longitudinal center plane of the coil support" can be interpreted to mean that the top side of the particular bearing tine is slanted to the longitudinal center plane and also faces toward the longitudinal center plane.

As mentioned at the outset, the invention also relates to a coil processing system.

The coil processing system according to the invention comprises a first coil processing station and a second coil processing station. Furthermore, the coil processing system according to the invention comprises at least one transport device of the above described kind, i.e., at least one transport device according to the invention for transporting a coil from one of the two coil processing stations to the other of the two coil processing stations.

By a coil processing system is meant a system for the processing of one or more coils. Processing of a coil means, in turn, performance of one or more process/method steps with or on the coil. The processing of a coil may involve for example weighing the coil, sampling of the coil, packaging of the coil, strapping of the coil and/or removal of a strapping band from the coil.

The coil processing system may be in particular a coil strapping system, i.e., a system for the strapping of a coil.

Moreover, the coil processing system may be for example a coil packaging system, i.e., a system for the packing of a coil with a packaging material.

In one preferred embodiment of the invention, the coil processing system is a coil sampling system, i.e., a system for taking a sample from a coil, i.e. sampling of a coil. In this case, one of the two coil processing stations is advisably a sampling station. The sampling station is advantageously outfitted with a severing device, such as shears or a plasma torch, which can be used for taking a sample from the coil.

The sampling system is not limited to the sampling of a coil. In addition to a sampling of a coil, the coil may also inter alia be weighed at the sampling system and/or enclosed with one or more strapping bands.

The other of the two aforementioned coil processing stations of the coil processing system may be for example a delivery station, a pick-up point, a weighing station, a band removal station or a strapping station.

If one of the coil processing stations is a strapping station, it may be in particular a circumference strapping station for strapping an outer circumference of a coil or an eye strapping station for strapping a coil through its coil eye. Furthermore, the strapping station may be a combined strapping station, which can be used both for the strapping of a coil through its coil eye and for strapping an outer circumference of the coil.

Furthermore, a coil passing through the coil sampling system need not necessarily be sampled. For example, the coil may run through the coil sampling system without being sampled in order to receive a strapping through its coil eye and/or around its outer circumference and/or to be weighed.

In addition to the two aforementioned coil processing stations, the coil processing system may also have one or more further coil processing stations.

The respective coil processing station of the coil processing system preferably comprises a coil receiver, on which the coil to be processed can be set down. Furthermore, the respective coil processing station may comprise one or more hold-down devices, such as a swivel arm with a hold-down roller. Such a hold-down device may be used to secure the coil to be processed on the coil receiver of the respective coil processing station.

If the coil processing system has multiple transport devices of the above described kind, the transport devices may be used in different areas of the coil processing system.

In the use according to the invention, the above described transport device, i.e., the transport device according to the invention, is used for the transporting of a coil in a coil processing system, especially in the above described coil processing system. In this process, the coil is transported from a first coil processing station of the coil processing system to a second coil processing station of the coil processing system by means of the transport device.

Alternatively or additionally, the transport device may be used to transport the coil from the second coil processing station to the first coil processing station of the coil processing system.

During the transport of the coil, the coil lies advantageously on the coil support of the transport device. Further, it may be provided that, during the transport of the coil, the clamping unit of the transport device is introduced into a coil eye of the coil. Furthermore, the coil may be pressed with the aid of the clamping unit against the coil support during its transport.

Alternatively, it is possible for the clamping unit not to be introduced into the coil eye of the coil during the transport of the coil. The clamping unit may be lowered during the transport of the coil for example at least partially in the coil support, especially in its cut-out.

The invention furthermore relates to a method for transporting a coil, as mentioned at the outset.

In the method according to the invention, the coil is transported with the aid of a transport device from a first coil processing station to a second coil processing station of a coil processing system.

The transport device used in the method is the above described transport device, i.e., the transport device according to the invention. Moreover, the following device elements mentioned in connection with the method may be in particular the previously mentioned device elements.

The method according to the invention provides that

- a coil transport cart of the transport device is driven up to the coil situated in/at the first coil processing station. Then a clamping unit of the transport device is introduced into a coil eye of the coil during this process, i.e., while driving up to the coil,
- the clamping unit introduced into the coil eye is lowered until the clamping unit presses against the coil,
- a coil support of the transport device is raised until the coil lies against the coil support,
- once the coil is lying against the coil support and the clamping unit presses against the coil, the coil support and the clamping unit are raised synchronously and
- the coil lying against the coil support is transported by means of the coil transport cart to the second coil processing station, and the coil is pressed by the clamping unit against the coil support during this process, i.e., while being transported.

The transported coil may, for example, be a hot strip coil, especially a hot strip coil of steel. Furthermore, the coil may optionally be strapped with at least one strapping band during its transport from the first coil processing station to the second coil processing station.

Before the coil transport cart is driven up to the coil, the height position of the clamping unit is preferably adjusted such that the clamping unit can be introduced into the coil eye during a horizontal displacement of the coil transport cart.

Raising the coil support enables lifting of the coil off from a coil receiver of the first coil processing station on which the coil is initially resting.

Synchronous raising of the coil support and the clamping unit means a movement of the coil support and the clamping unit in which these two elements are raised at the same speed.

When the coil has reached the second coil processing station, the coil support and the clamping unit are preferably lowered synchronously, i.e., at the same speed, until the coil lies against a coil receiver of the second coil processing station. Then the coil support is preferably lowered. In one advantageous embodiment of the invention, the coil during the lowering of the coil support, the coil is pressed by the clamping unit against the coil receiver of the second coil processing station.

Moreover, it may be provided that, while the coil is located in/at the first coil processing station, a hold-down device of the first coil processing station may press against the coil, especially against its outer circumference. The hold-down device is removed from the coil when the clamping unit presses against the coil. With the hold-down device removed, bouncing up of the coil can be prevented by the clamping unit, so that danger to persons or equipment can be avoided.

In one variant embodiment of the invention, when the coil has reached the second coil processing station, the clamping unit is only lifted up from the coil when a hold-down device of the second coil processing station presses against the coil, especially against its outer circumference.

Once the coil has been set down on the coil receiver of the second coil processing station, the coil transport cart can be driven away from the coil. After this, the clamping unit may be lowered at least partly in a cut-out of the coil support. Next, the coil transport cart, now with a lowered clamping unit, can be driven up once more to the coil.

Moreover, the coil support may be raised until the coil lies against the coil support. The coil resting on the coil support can then be transported with the aid of the coil transport cart away from the second coil processing station, particularly, back to the first coil processing station or to another coil processing station.

However, driving of the coil transport cart away from the coil and lowering of the clamping unit in the coil support are not absolutely necessary in order to be able to transport the coil away from the second coil processing station.

Moreover, it is basically possible to lower the clamping unit, which is at least partly in the coil support during the transport of the coil from the first to the second coil processing station.

The description of advantageous embodiments of the invention contains many features which are represented in the individual dependent patent claims, sometimes combined into several features. However, these features may also be viewed individually and be assembled into expedient further combinations. In particular, these features may be combined in each case individually and in any suitable combination with the transport device according to the invention, the coil processing system according to the invention, the use according to the invention and the method according to the invention. Moreover, method features may also be seen as an attribute of the corresponding device unit.

Even though certain terms are used in the singular or in connection with a numeral in the specification or in the patent claims, the scope of the invention should not be limited for these terms to the singular or the particular numeral.

The above described attributes, features and benefits of the invention as well as the manner in which these are achieved will become more clear and understandable in connection with the following description of the exemplary embodiments of the invention, which are explained more closely in connection with the drawings. These exemplary embodiments serve for explaining the invention and do not limit the invention to the combinations of features indicated therein, even in regard to functional features. Moreover, for this purpose suitable features of each exemplary embodiment may also be viewed explicitly in isolation, removed from an exemplary embodiment, placed in another exemplary embodiment to supplement it, or be combined with any one of the claims.

DESCRIPTION OF EMBODIMENTS

Figure 1:
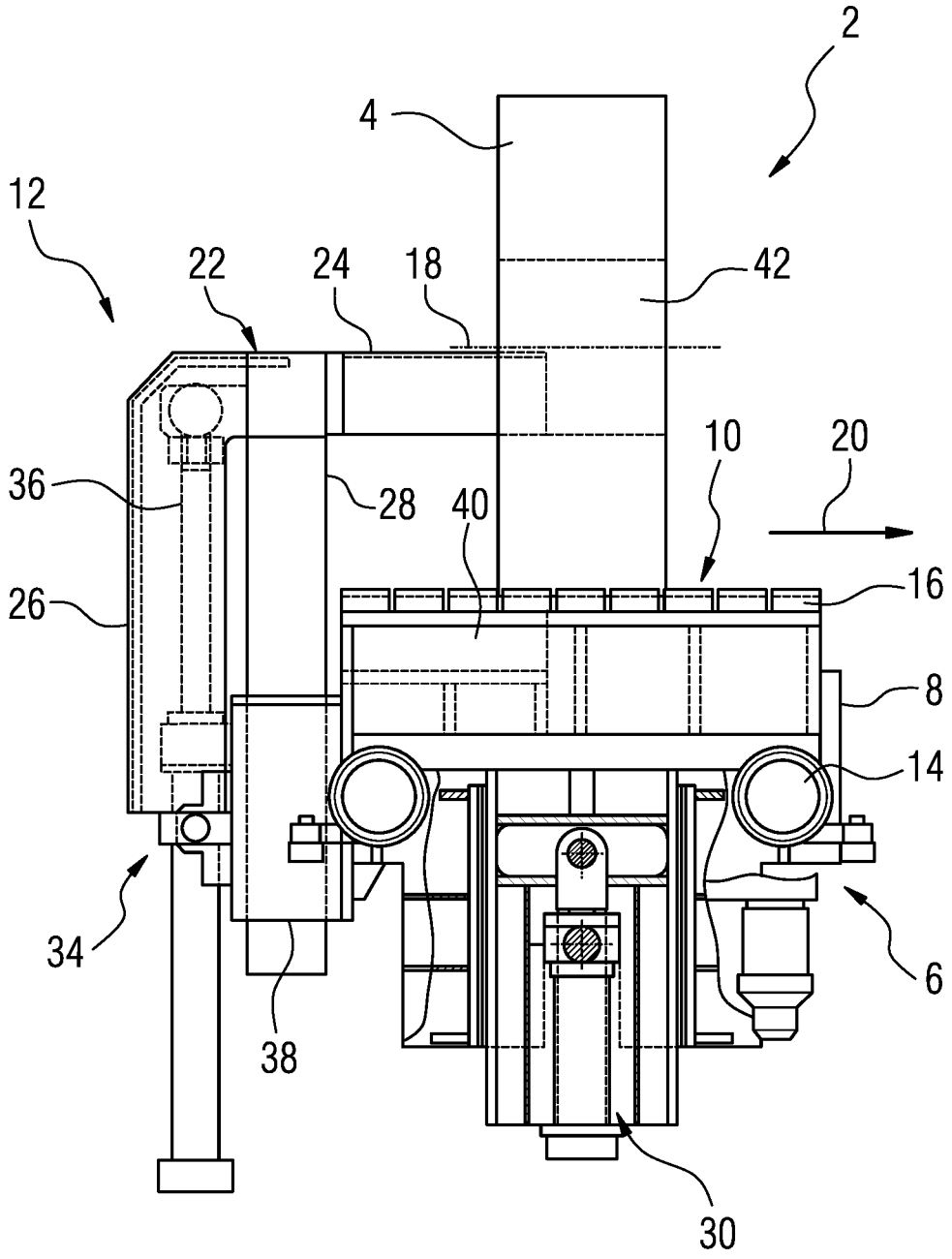
FIG. 1 is a side view of a first variant embodiment of a transport device and of a coil lying against the transport device, in a condition in which a coil support of the transport device is lowered.

FIG. 1 shows a side view of a first variant embodiment of a transport device 2 for transporting a coil. A coil 4 to be transported with the aid of the transport device 2 is likewise represented in FIG. 1.

The transport device 2 comprises a coil transport cart 6 with a chassis 8 and a coil support 10. Furthermore, the transport device 2 comprises a fastening device 12.

The coil transport cart 6 comprises four rotatably mounted wheels 14, which are mounted on the chassis 8 of the coil transport cart 6. By means of these wheels 14, the coil transport cart 6 can travel on a rail track.

The aforementioned coil support 10 is outfitted with a plurality of bearing tines 16. As can be seen in FIG. 1, the coil 4 to be transported lies against the coil support 10, more precisely against its bearing tines 16. The coil 4 lays against the coil support 10 in such a way that its coil axis 18 is oriented parallel to the longitudinal direction 20 of the coil support 10.

The fastening device 12 comprises a clamping unit for pressing the coil to be transported 4 against the coil support 10. The clamping unit 22 has a clamping section 24, which is oriented parallel to the longitudinal direction 20 of the coil support 10. The clamping unit 22 has a base section 26 joined to the clamping section 24 and has a sliding section 28 joined to the clamping section 24. Both the base section 26 and the sliding section 28 are oriented perpendicular to the clamping section 24 of the clamping unit 22.

The coil support 10 is height-adjustable with respect to the chassis 8. In other words, the height position of the coil support 10 can be moved relative to the chassis 8.

Moreover, the coil transport cart 6 comprises a drive unit 30 for raising and lowering the coil support 10. In the present exemplary embodiment, this drive unit 30 is designed as a hydraulic lift cylinder, having a lifting rod 32 (see FIG. 2). In order to raise the coil support 10 relative to the chassis 8, the lifting rod 32 of the drive unit 30 is extended. In order to lower the coil support 10 relative to the chassis 8, the lifting rod 32 of the drive unit 30 is retracted.

Furthermore, the clamping unit 22 is height-adjustable with respect to the coil support 10, so that, the height position of the clamping unit 22 can be moved relative to the coil support 10.

The fastening device 12 comprises a drive unit 34 for raising and lowering the clamping unit 22. The drive unit 34 comprises a hydraulic lift cylinder with a lifting rod 36. Moreover, the drive unit 34 of the fastening device 12, more precisely its lifting rod 36, is integrated in the base section 26 of the clamping unit 22. In order to raise the clamping unit 22 relative to the coil support 10, the lifting rod 36 of the drive unit 34 of the fastening device 12 is extended. On the other hand, in order to lower the clamping unit 22 relative to the coil support 10, the lifting rod 36 of this drive unit 34 is retracted.

In the present embodiment, the fastening device 12, and more precisely its drive unit 34, is fastened to the coil support 10. Moreover, the coil support 10 has a sliding guide 38, by which the aforementioned sliding section 28 of the clamping unit 22 is guided and by means of which the clamping unit 22 is mounted in a linearly displaceable manner.

Furthermore, the coil support 10 comprises a cut-out 40, into which the clamping section 24 of the clamping unit 22 can be lowered if pressing of the coil 4 against the coil support 10 is not required.

In FIG. 1, the coil support 10 is in its lowest position with respect to the chassis 8. In this state, the lifting rod 32 of the drive unit 30 of the coil transport cart 6 is retracted as much as possible. Moreover, the clamping section 24 of the clamping unit 22 is introduced into a coil eye 42 of the coil to be transported 4 and the clamping section there presses the coil 4 against the coil support 10.

Figure 2:
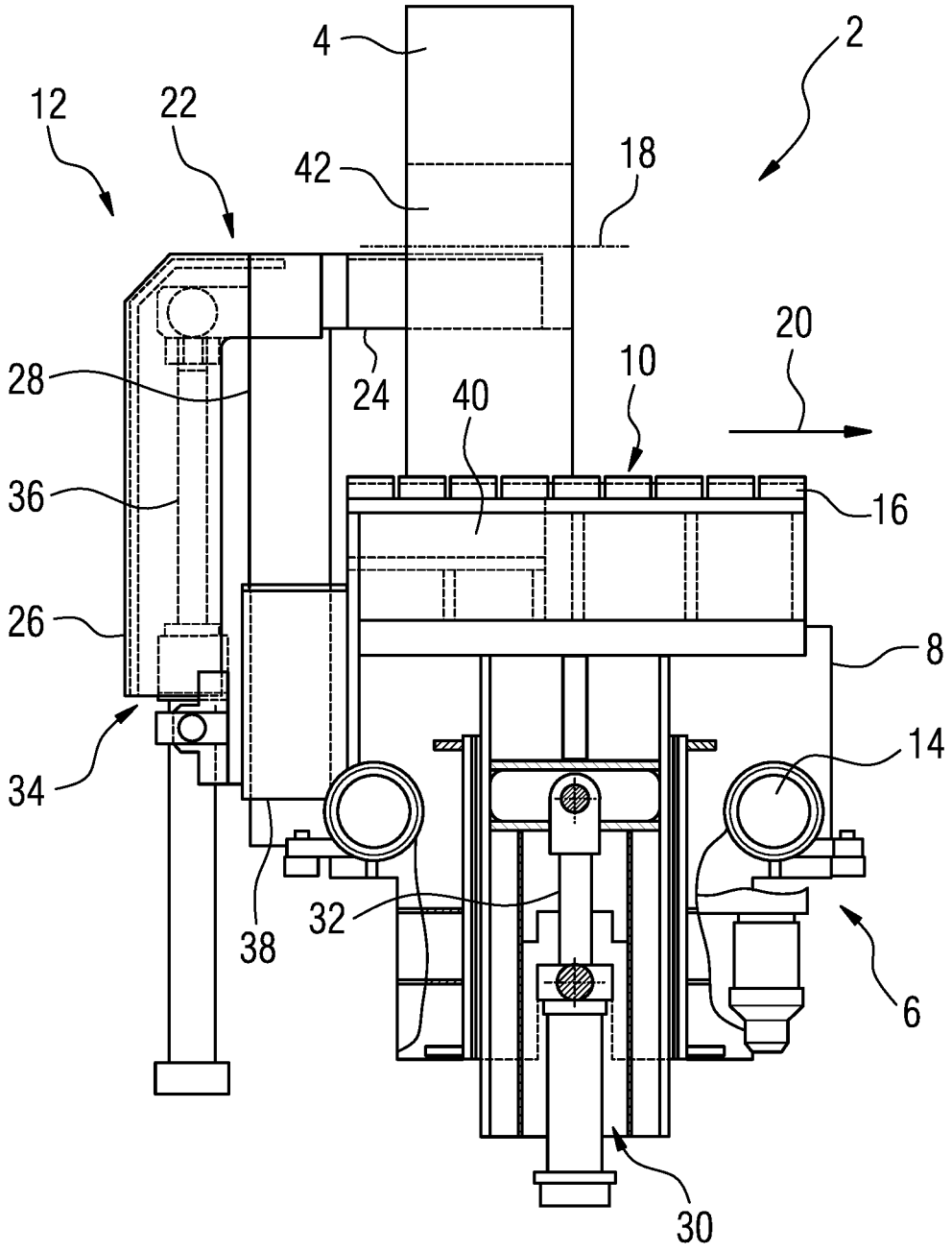
FIG. 2 is a side view of the transport device of FIG. 1 and of a coil lying against the transport device, in a condition in which the coil support is raised.

FIG. 2 shows a further side view of the transport device 2 of FIG. 1.

In this Figure also, a coil to be transported 4 lies against the coil support 10 of the transport device 2. Furthermore, the clamping unit 22 is introduced longitudinally/axially into a coil eye 42 of the coil to be transported 4 and presses the coil against the coil support 10 of the transport device 2.

In comparison to the state of the transport device 2 shown in FIG. 1, the coil support 10 is raised in FIG. 2. Thus, the coil support 10 is situated in a higher position relative to the chassis 8 than in FIG. 1. Accordingly, the aforementioned drive unit 30 of the coil transport cart 6, more precisely its lifting rod 32, is extended further than in FIG. 1.

Figure 3:
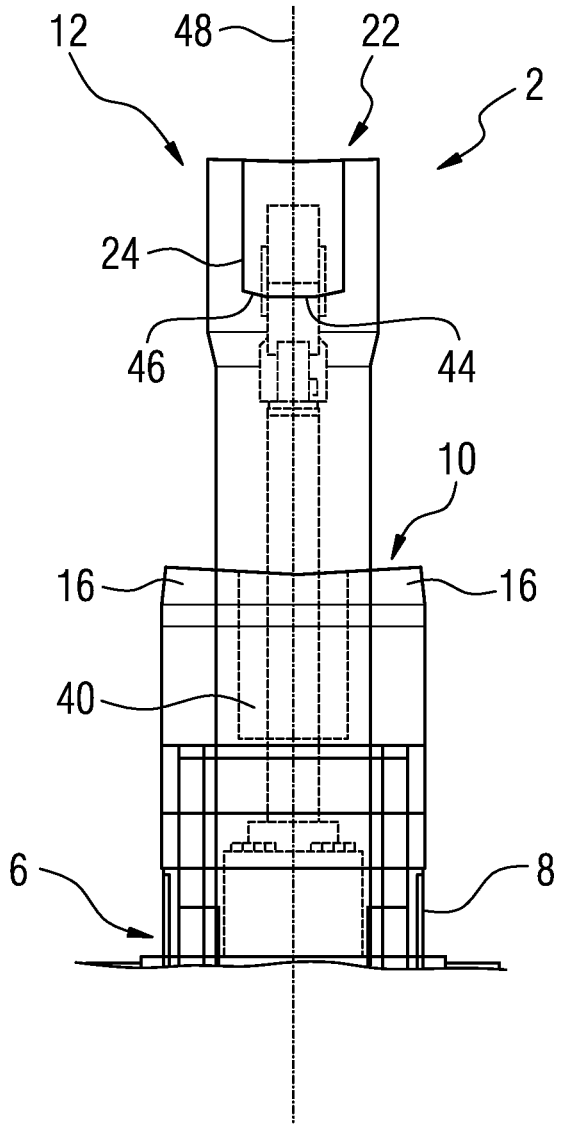
FIG. 3 is a front view of the transport device of FIG. 1 and FIG. 2.

FIG. 3 shows a front view of the transport device 2 of FIG. 1 and FIG. 2.

FIG. 3 shows that the clamping unit 22 has a rounded pressing surface 44, by which the clamping unit 22 can be pressed against a coil eye of a coil to be transported. The rounded pressing surface 44 is located on the bottom side 46 of the clamping section 24 of the clamping unit 22. The surface has a curvature that generally follows the curvature of the coil eye.

FIG. 3 shows that the bearing tines 16 are beveled toward the longitudinal center plane 48 of the coil support 10. In this way, the bearing tines 16 stabilize the coil to be transported on the coil support 10 transversely to its longitudinal direction 20.

The descriptions of the following exemplary embodiments are confined primarily to the differences from the preceding exemplary embodiment, making reference to this in regard to the features and functions which are the same. Basically identical and/or corresponding elements are denoted with the same reference numbers so far as is practicable and features not mentioned have been adopted in the following exemplary embodiments without be described again.

Figure 4:
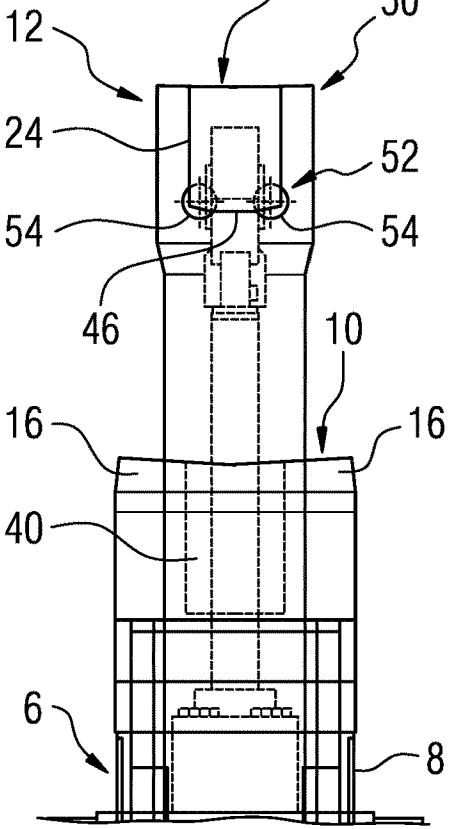
FIG. 4 is a front view of a second variant embodiment of a transport device for transporting a coil.

FIG. 4 shows a front view of a second variant embodiment of a transport device 50 for transporting a coil.

The clamping unit 22 of this transport device 50 is outfitted with a friction reducing unit 52. The friction reducing unit 52 reduces a frictional resistance between a coil to be transported and the clamping unit 22 if the coil is supposed to be rotated while resting against the coil support 10 and the clamping unit 22 presses against the coil. A rotating of a coil resting on the coil support 10 can be done for example during the winding and unwinding of the coil, especially in the course of a sampling of the coil.

In the present embodiment, the friction reducing unit 52 comprises a plurality of rotatably mounted rollers 54 serving as the friction reducing means. These rollers 54 are arranged on the bottom side 46 of the clamping section 24 of the clamping unit 22.

Figure 5:
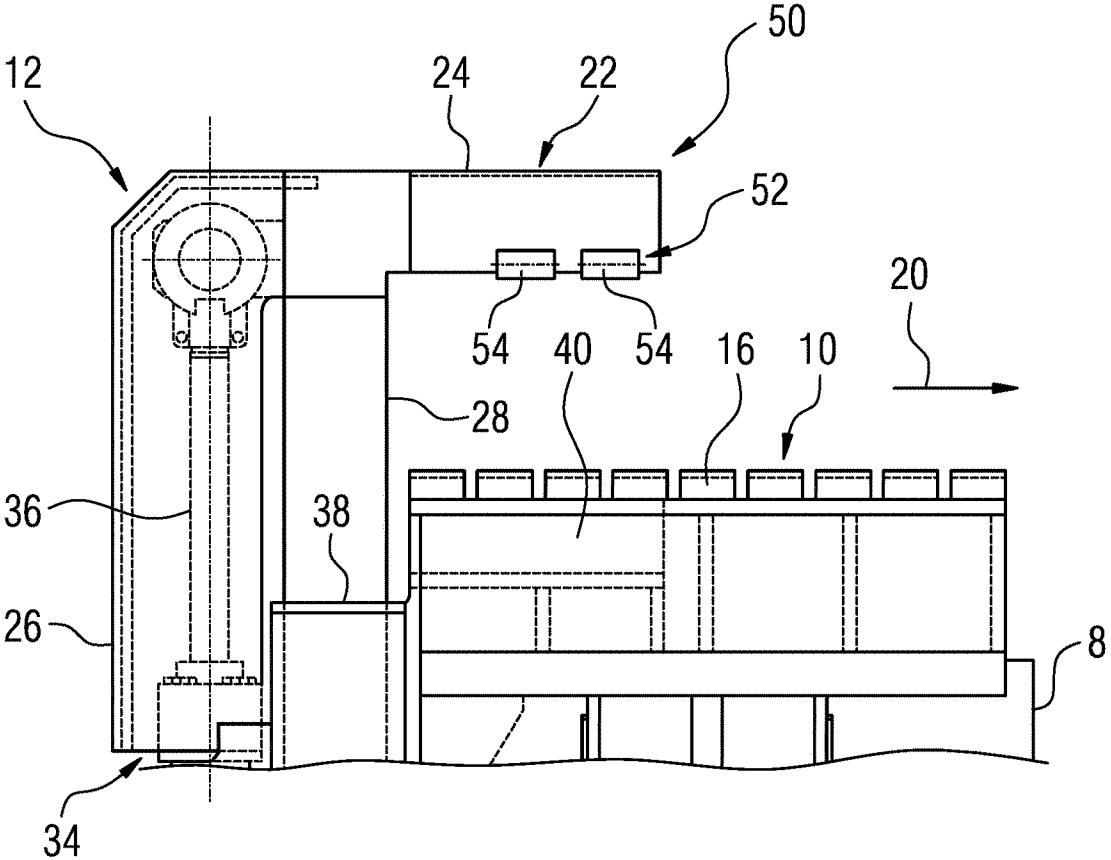
FIG. 5 is a side view of the transport device of FIG. 4.

FIG. 5 shows a side view of the transport device 50 of FIG. 4. FIG. 5 shows that the rollers 54 of the friction reducing unit 52 are situated at the end of the clamping section 24 at a distance from the base section 26 of the clamping unit 22.

Figure 6:
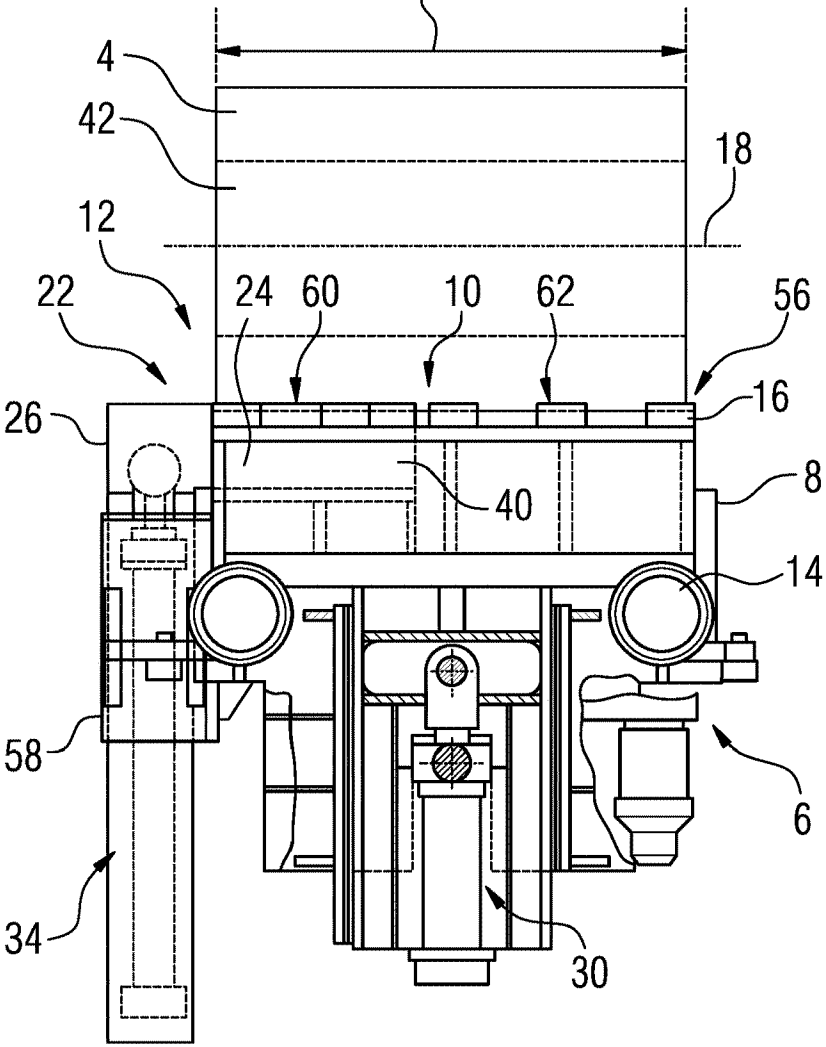
FIG. 6 is a side view of a third variant embodiment of a transport device and of a coil lying against the transport device, in a condition in which a clamping unit of the transport device is lowered in its coil support.

FIG. 6 shows a side view of a third variant embodiment of a transport device 56 for transporting a coil. In this transport device 56, the fastening device 12, and especially its drive unit 34, is mounted not on the coil support 10, but rather on the chassis 8 of the coil transport cart 6. Moreover, the coil support 10 has no sliding guide for the clamping unit 22. Instead, the chassis 8 has a sliding guide 58 for the clamping unit 22.

The base section 26 of the clamping unit 22 is led by the sliding guide 58 of the chassis 8 and mounted in a linearly displaceable longitudinal direction manner with the aid of the sliding guide 58. In the transport device 56 of FIG. 6, the base section 26 in which the drive unit 34 of the fastening device 12 is integrated thus at the same time performs the function of the sliding section 28 of the clamping unit 22 of previous exemplary embodiments. Therefore, no separate sliding section is provided in the present exemplary embodiment for the clamping unit 22. Moreover, the transport device 56 from FIG. 6 comprises a synchronization device (not depicted) for synchronizing the movements of the clamping unit 22 and the coil support 10.

In the illustrated state of the transport device 56 shown in FIG. 6, the clamping unit 22 is not introduced into a coil eye 42 of a coil to be transported 4. Instead, the clamping unit 22, or more precisely its clamping section 24, is lowered into the cut-out 40 of the coil support 10, especially in such a way that the top side 60 of the clamping section 24 is flush with the top side 62 of the coil support 10. The coil to be transported 4 lies in this case against the coil support 10 as well as the top side 60 of the clamping section 24.

Moreover, the width 64 of the coil to be transported 4 extends in the present exemplary embodiment substantially across the entire length of the coil support 10.

Figure 7:
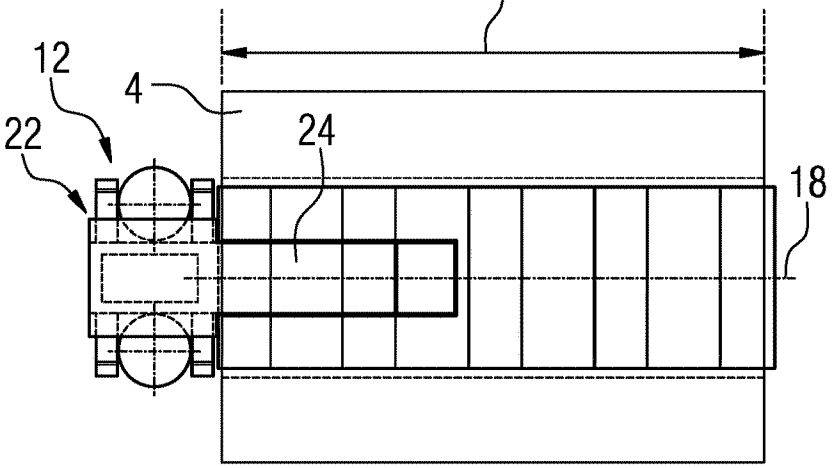
FIG. 7 is a top view of the transport device of FIG. 6 and of a coil resting against the transport device.

FIG. 7 shows a top view of the transport device 56 of FIG. 6 as well as the coil 4 resting on its coil support 10.

Figure 8:
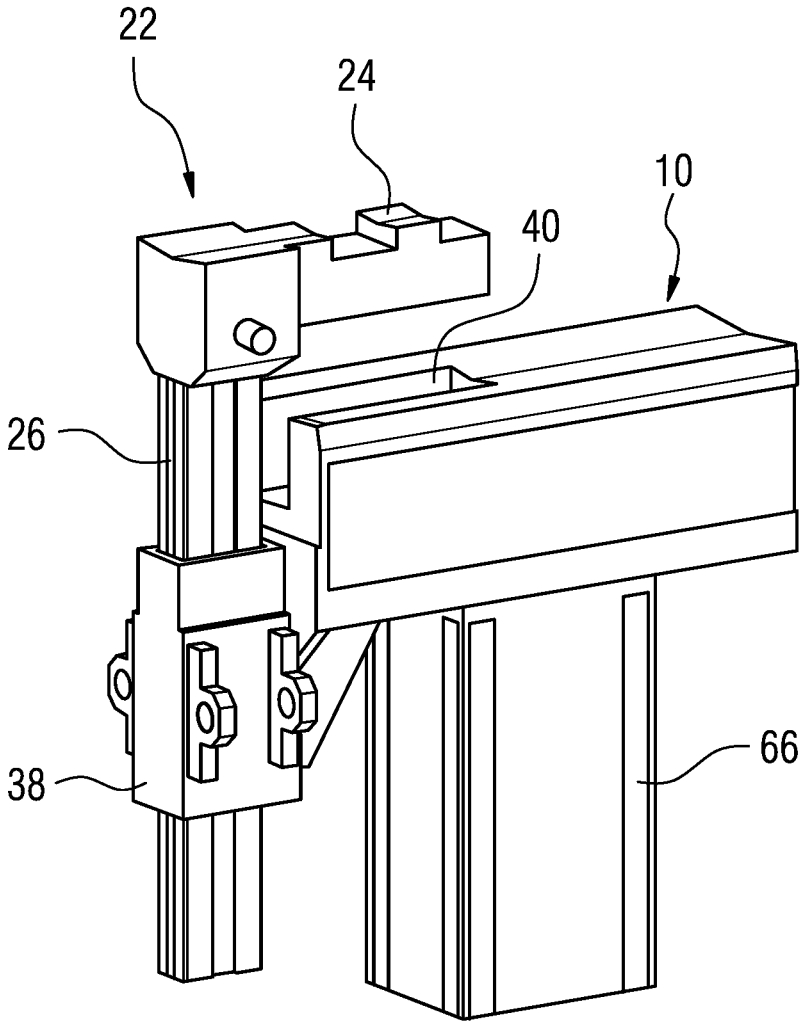
FIG. 8 is a 3D view of one possible variant embodiment of a coil support and of a clamping unit for a transport device for transporting a coil.

FIG. 8 shows a ¾ or oblique view in 3D of one possible variant embodiment of a coil support 10 as well as a clamping unit 22 for a transport device for transporting a coil.

The coil support 10 has a sliding section 66, which can be installed in a sliding guide of a chassis.

Furthermore, the coil support 10 has a sliding guide 38. The clamping unit 22, or more precisely its base section 26, is led through this sliding guide 38, and mounted in a linearly displaceable manner by means of the sliding guide 38.

In the clamping unit 22 of FIG. 8, the base section 26 at the same time performs the function of the sliding section 28 of the clamping unit 22 of previous exemplary embodiments. Therefore, no separate sliding section is provided in the present exemplary embodiment for the clamping unit 22.

Moreover, there can be seen in FIG. 8 a cut-out 40 of the coil support 10, in which the clamping unit 22, or more precisely its clamping section 24, can be lowered.

Figure 9:
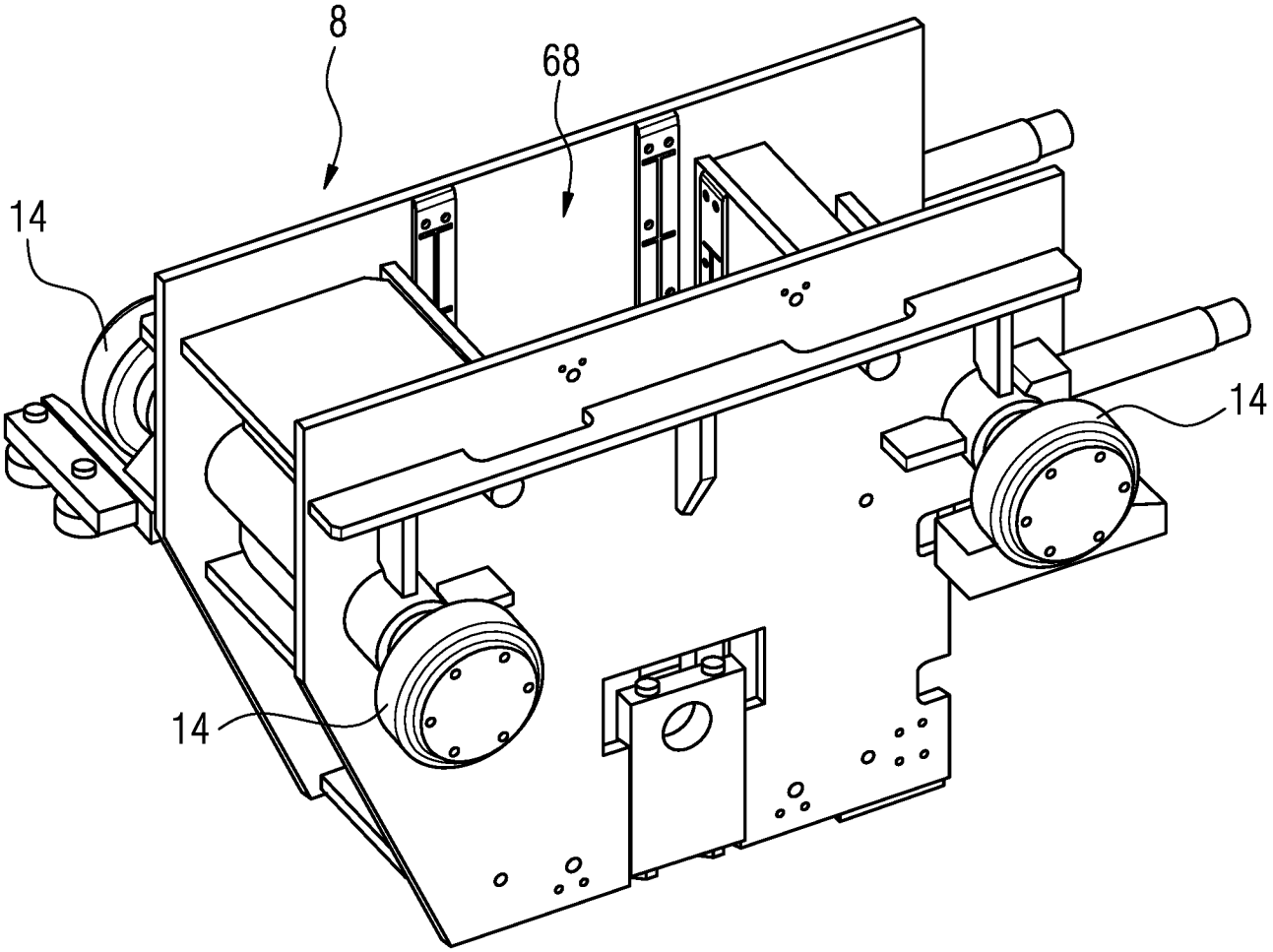
FIG. 9 is a 3D view of one possible variant embodiment of a chassis for a transport device for transporting a coil.

FIG. 9 shows a ¾ view in 3D of one possible variant embodiment of a chassis 8 for a transport device for transporting a coil.

The chassis 8 comprises a sliding guide 68 for the guiding of a coil support. This sliding guide 68 is designed in particular to receive a sliding section of a coil support, such as the sliding section 66 of the coil support 10 of FIG. 8.

Furthermore, four rotatably mounted wheels 14 are mounted on the chassis 8, by means of which the chassis 8 can travel on a rail track. In FIG. 9, however, only three of these four wheels 14 can be seen (at least partly).

Figure 10:
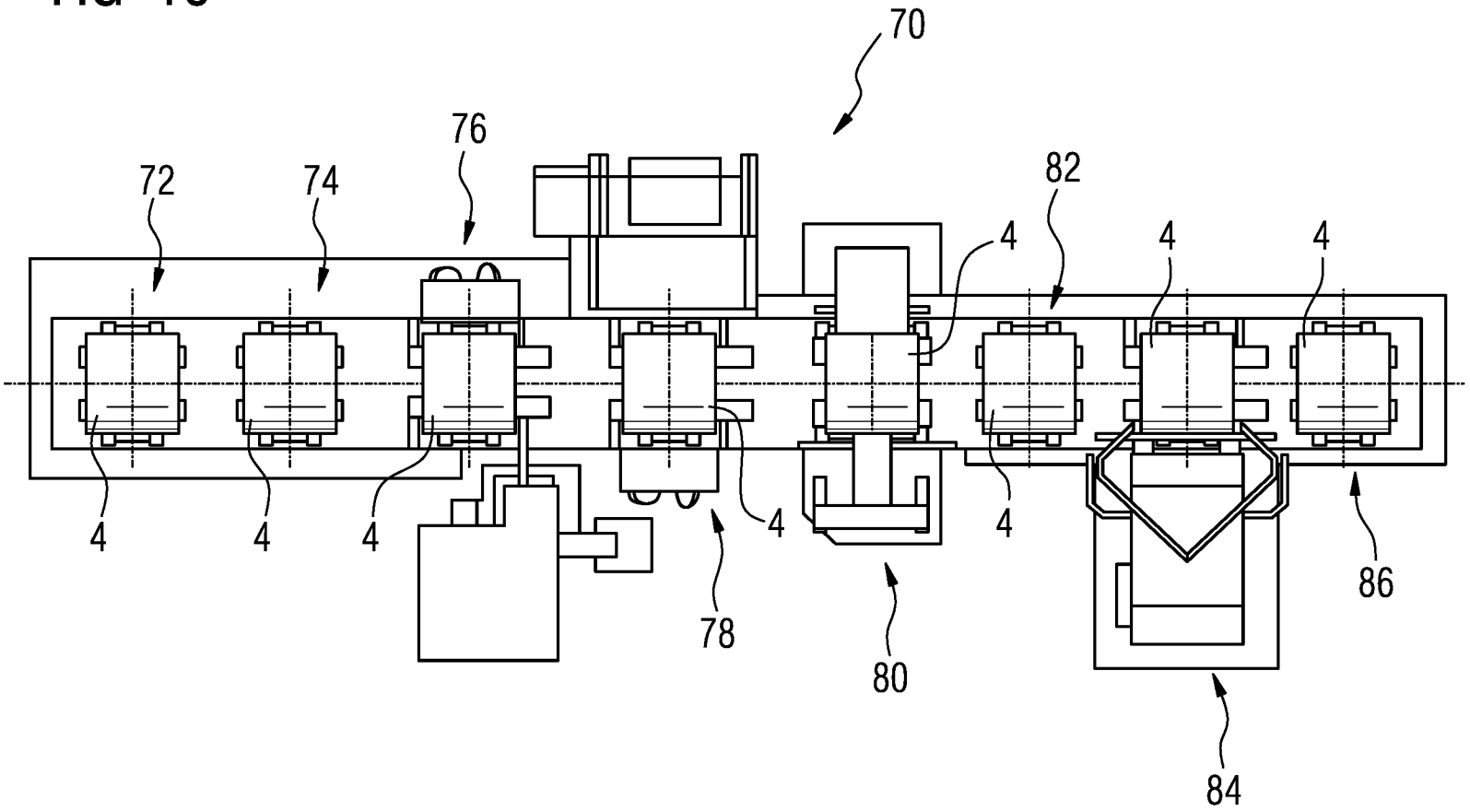
FIG. 10 is a top view of a coil processing system.

FIG. 10 shows a top view of a coil processing system 70, which in the present exemplary embodiment is a coil sampling system.

This coil processing system 70 comprises eight coil processing stations 72-86. Basically, embodiments of the coil processing system 70 are also possible in which the coil processing system 70 has a different number of coil processing stations. In the present exemplary embodiment, the coil processing stations 72-86 are a first delivery station 72, a second delivery station 74, a band removal station 76, a sampling station 78, a circumference strapping station 80, a weighing station 82, an eye strapping station 84 and a pick-up point 86. The individual coil processing stations 72-86 need not necessarily be arranged in the sequence shown in FIG. 10.

Furthermore, the coil processing system 70 comprises a transport device 88 (not shown in FIG. 10), which can travel on a rail track 90 (see FIG. 12) of the coil processing system 70 and corresponds in terms of its design to one of the previously described transport devices 2, 50, 56.

In FIG. 10, each of the coil processing stations 72-86 is shown occupied, for example by a coil 4. It is possible for only some of the coil processing stations 72-86 to be occupied by a coil 4 at the same time.

The following describes in exemplary fashion for an individual coil 4 how this coil 4 is processed in the coil processing system 70. It shall be assumed that this coil 4 is closed by a circumferential strapping, i.e., by a binding strap extending around the outer circumference of the coil 4.

The coil 4 is transported with the aid of a transport system (not depicted), such as a crane, to the coil processing system 70 and set down at the first or second delivery station 72, 74.

By means of the previously mentioned transport device 88 of the coil processing system 70, the coil 4 is transported in the following described manner from the first or second delivery station 72, 74 to the band removal station 76.

First, the height position of the clamping unit 22 of the transport device 88 is adjusted such that the clamping unit 22 can be introduced, during a horizontal displacement of the coil transport cart 6, into a coil eye 42 of the coil 4.

The coil transport cart 6 of the transport device 88 is driven up to the coil 4 located in the first or second delivery station 72, 74 and the clamping unit 22 of the transport device 88 is introduced into the coil eye 42 of the coil 4.

The clamping unit 22 introduced into the coil eye 42 is lowered until the clamping unit 22 presses against the coil 4. The coil support 10 of the transport device 88 is then raised until the coil 4 lies against the coil support 10. The height position of the clamping unit 22 does not change in this process. Next, the coil support 10 and the clamping unit 22 are raised synchronously.

The coil 4 lying against the coil support 10 is then transported by the coil transport cart 6 to the band removal station 76, where the coil 4 is pressed during the transport by the clamping unit 22 against the coil support 10.

Figure 11:
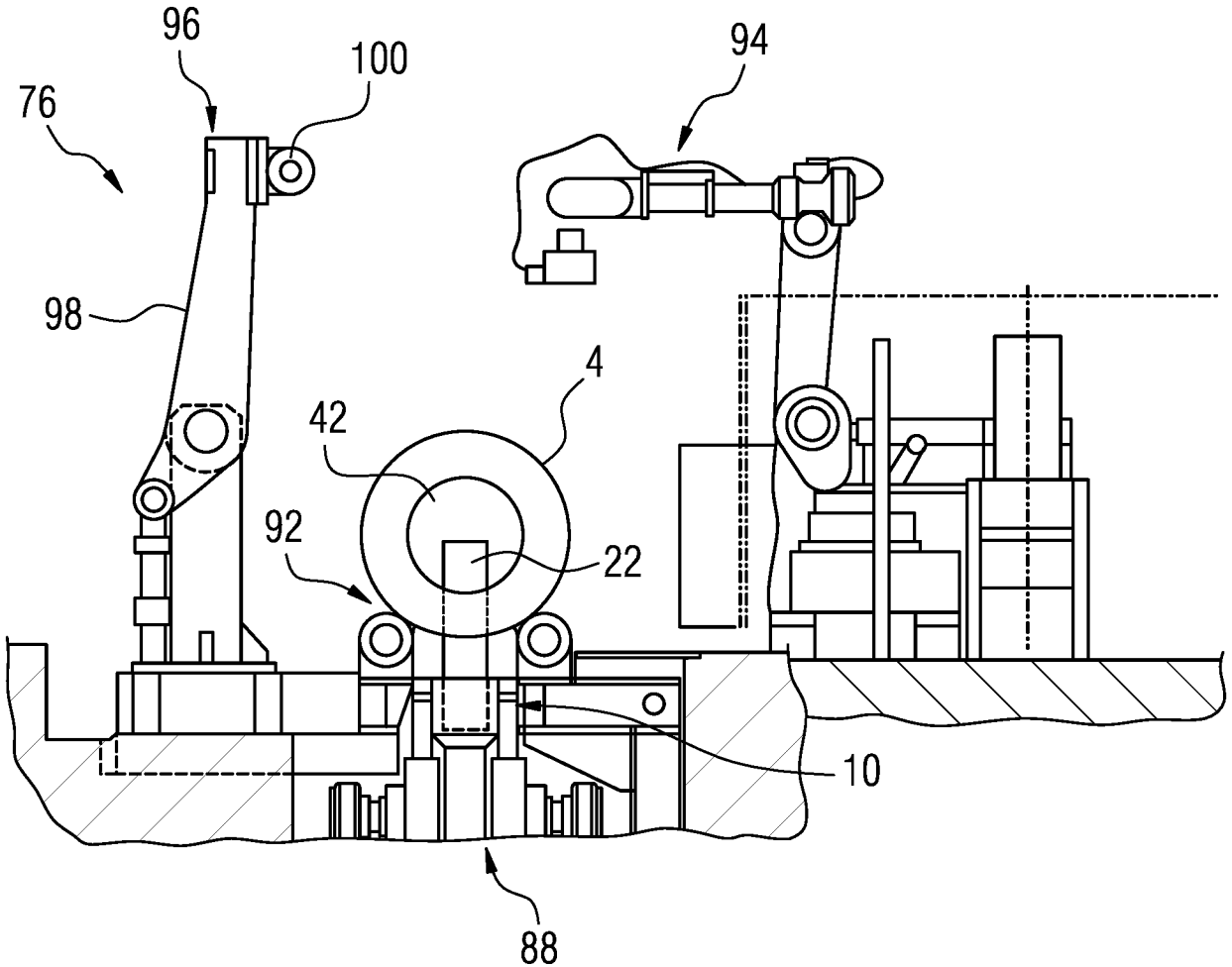
FIG. 11 is a side view of a band removal station of the coil processing system of FIG. 10.

In FIG. 11, when the coil 4 has reached the band removal station 76, the coil support 10 and the clamping unit 22 are lowered synchronously until the coil 4 lies against a coil receiver 92 of the band removal station 76 (as seen in FIG. 11). The coil support 10 is then lowered, while the coil 4 during the lowering of the coil support 10 is pressed by the clamping unit 22 against the coil receiver 92 of the band removal station 76. In the band removal station 76, the circumferential strapping of the coil 4 is removed.

Then the coil 4 is transported by the transport device 88 from the band removal station 76 to the sampling station 78. In the sampling station 78, a sample is taken from the coil 4.

The coil 4 is then transported by the transport device 88 from the sampling station 78 to the circumference strapping station 80. Here, the coil 4 receives a circumferential strapping.

After this, the coil 4 is transported from the circumference strapping station 80 to the weighing station 82, where the coil 4 is weighed.

After being weighed, the coil 4 is transported by the transport device 88 from the weighing station 82 to the eye strapping station 84, where the coil 4 receives a strapping through its coil eye 42.

Then the coil 4 is transported by the transport device 88 from the eye strapping station 84 to the pick-up point 86. Here, the coil 4 is transported with the aid of a transport system (not depicted), such as a crane, away from the coil processing system 70.

The transport of the coil 4 from one of the coil processing stations 72-86 to the respective next coil processing station 72-86 is done in the same way as described above during the transport from the first or second delivery station 72, 74 to the band removal station 76.

FIG. 11 shows a side view of the band removal station 76 of the coil processing system 70 of FIG. 10.

The band removal station 76 comprises a band removal device 94 configured for removing a strapping band from the coil 4. Furthermore, the band removal station 76 in the present example comprises a hold-down device 96, having a swivel arm 98 with a hold-down roller 100 fastened to the swivel arm 98.

In FIG. 11, the coil 4 to be processed has been set down on the coil receiver 92 of the band removal station 76. Furthermore, the coil support 10 of the transport device 88 has been lowered, so that the coil support 10 is at a distance from the coil 4.

Moreover, in FIG. 11 the coil 4 is pressed by the clamping unit 22, which is introduced into the coil eye 42 of the coil 4, against the coil receiver 92. This makes possible a danger-free removal of the circumferential strapping of the coil 4, since with the aid of the clamping unit 22, bouncing of the coil 4 upon removal of the circumferential strapping is prevented. Therefore, the aforementioned hold-down device 96 of the band removal station 76 can basically be omitted, as long as the transport device 88 is not being used during the removal of the circumferential strapping for the transport of another coil 4.

Figure 12:
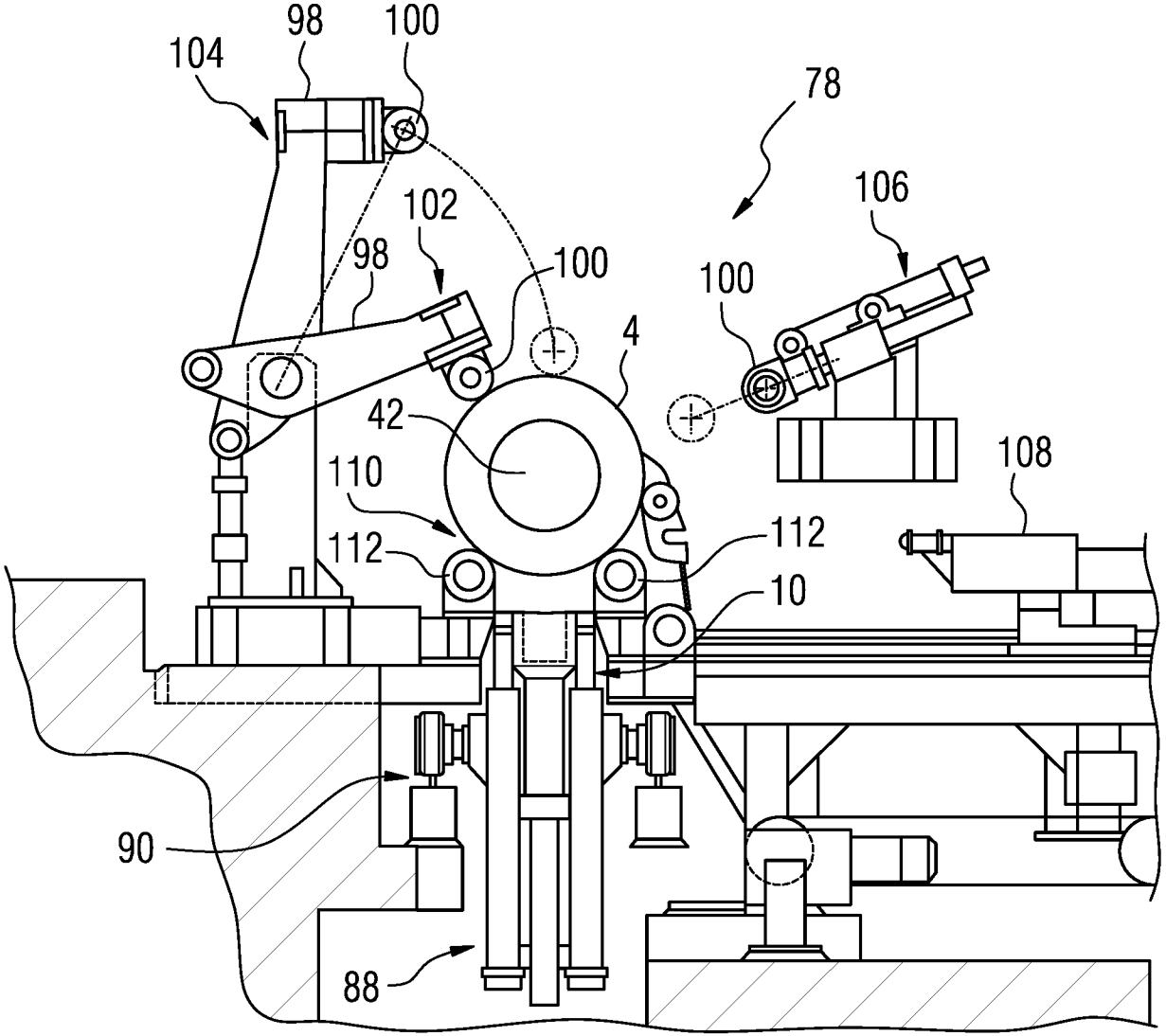
FIG. 12 is a side view of a sampling station of the coil processing system of FIG. 10.

FIG. 12 shows a side view of the sampling station 78 of the coil processing system 70 of FIG. 10.

The sampling station 78 comprises a first hold-down device 102 and a second hold-down device 104, each having a swivel arm 98 and a hold-down roller 100 fastened to the swivel arm 98. Furthermore, the sampling station 78 comprises a third hold-down device 106, which is outfitted with a linearly displaceable hold-down roller 100.

The sampling station 78 comprises a movable severing device 108 for the separation of a sample from a coil 4. In the present exemplary embodiment, the severing device 108 is a plasma torch.

Moreover, FIG. 12 shows the aforementioned rail track 90, on which the transport device 88 can travel.

In FIG. 12, the coil 4 has been set down on a coil receiver 110 of the sampling station 78, having two bottom rollers 112. For the unwinding of the coil 4 and its winding up once more for its sampling, the coil 4 can be rotated on the bottom rollers 112 of the coil receiver 110.

The coil support 10 of the transport device 88 is lowered in FIG. 12, so that the coil support 10 is at a distance from the coil 4. Moreover, the coil 4 is pressed by the first hold-down device 102 against the bottom rollers 112. Alternatively or additionally, the coil 4 can be pressed by at least one of the other two hold-down devices 104, 106 against the bottom rollers 112.

Moreover, the clamping unit 22 of the transport device 88 in FIG. 12 is lowered in the coil support 10. Alternatively or additionally to the hold-down devices 102, 104, 106, the clamping unit 22 may be used to press the coil 4 against the bottom rollers 112.

Figure 13:
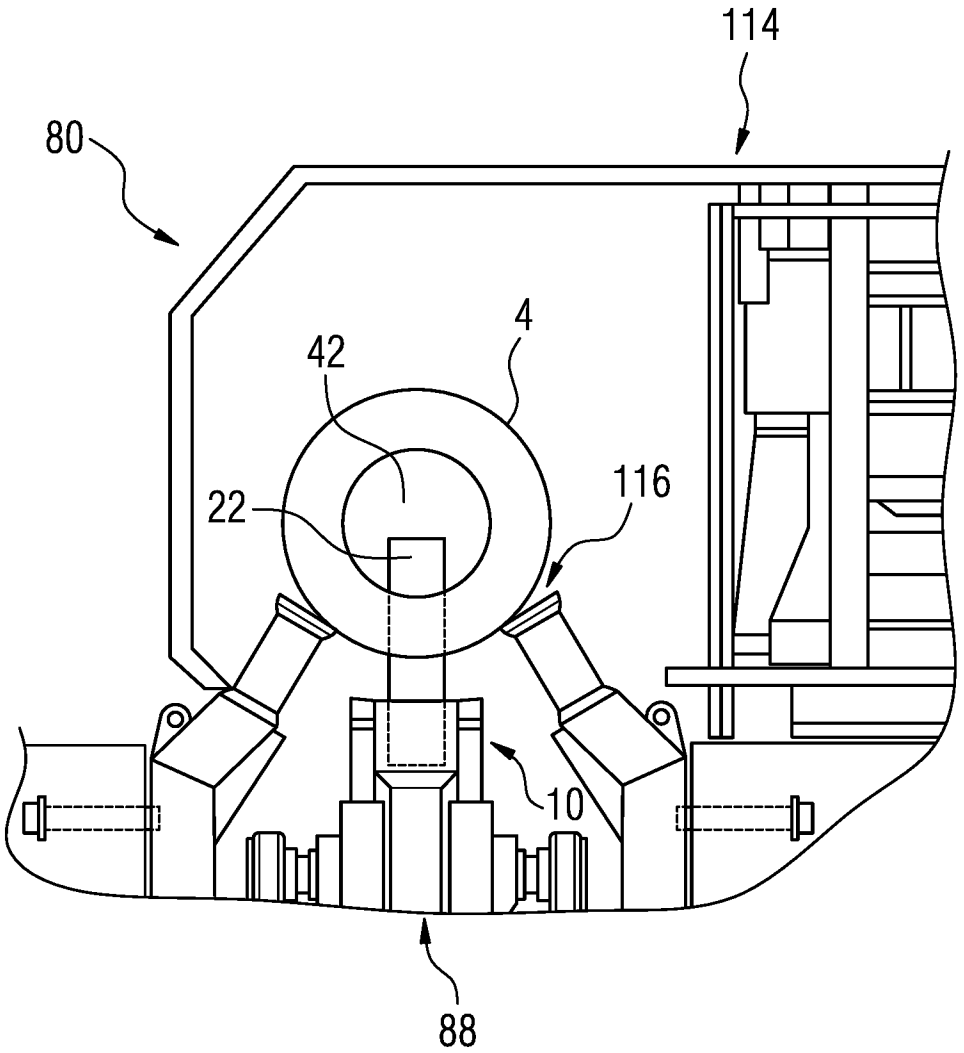
FIG. 13 is a side view of a circumference strapping station of the coil processing system of FIG. 10.

FIG. 13 shows a side view of the circumference strapping station 80 of the coil processing system 70 of FIG. 10. The circumference strapping station 80 comprises a strapping device 114 for the strapping of a coil 4 at its outer circumference. Furthermore, the circumference strapping station 80 comprises a coil receiver 116.

In FIG. 13, the coil 4 has been set down on the coil receiver 116 of the circumference strapping station 80. Moreover, the coil 4 is pressed by the clamping unit 22 of the transport device 88, which is introduced into the coil eye 42 of the coil 4, against the coil receiver 116. The coil support 10 of the transport device 88 is lowered, so that it is at a distance from the coil 4.

If pressing of a coil to be transported against the coil support 10 of the transport device 88 is not required, the clamping unit 22 can be lowered (or remain lowered) in the coil support 10 and the coil is transported, in the lowered state of the clamping unit 22 resting on the coil support 10, from one of the coil processing stations 72-86 to one of the other coil processing stations 72-86.

If a coil that has been set down at the first or second delivery station 72, 74 is not going to be sampled in the coil processing system 70, but is to be merely strapped and possibly also weighed, the coil may be transported from the first or second delivery station 72, 74 by the transport device 88 directly to the circumference strapping station 80 or the eye strapping station 84.

Further, a coil which is not closed by one or more strapping bands may be introduced into the coil processing system 70 in order to be sampled. In this case, the coil can be transported from the first or second delivery station 72, 74 by the transport device 88 directly to the sampling station 78, i.e., without stopping on the way at the band removal station 76.

Moreover, it is possible for the coil processing system 70 to comprise a plurality of transport devices of the above described kind. These may be employed in different areas of the coil processing system 70. For example, the transport device 88 may be used for transport of a coil from the first delivery station 72 to the sampling station 78, while an additional transport device may be used for transport of the same coil from the sampling station 78 to the pick-up point 86.

Figure 14:
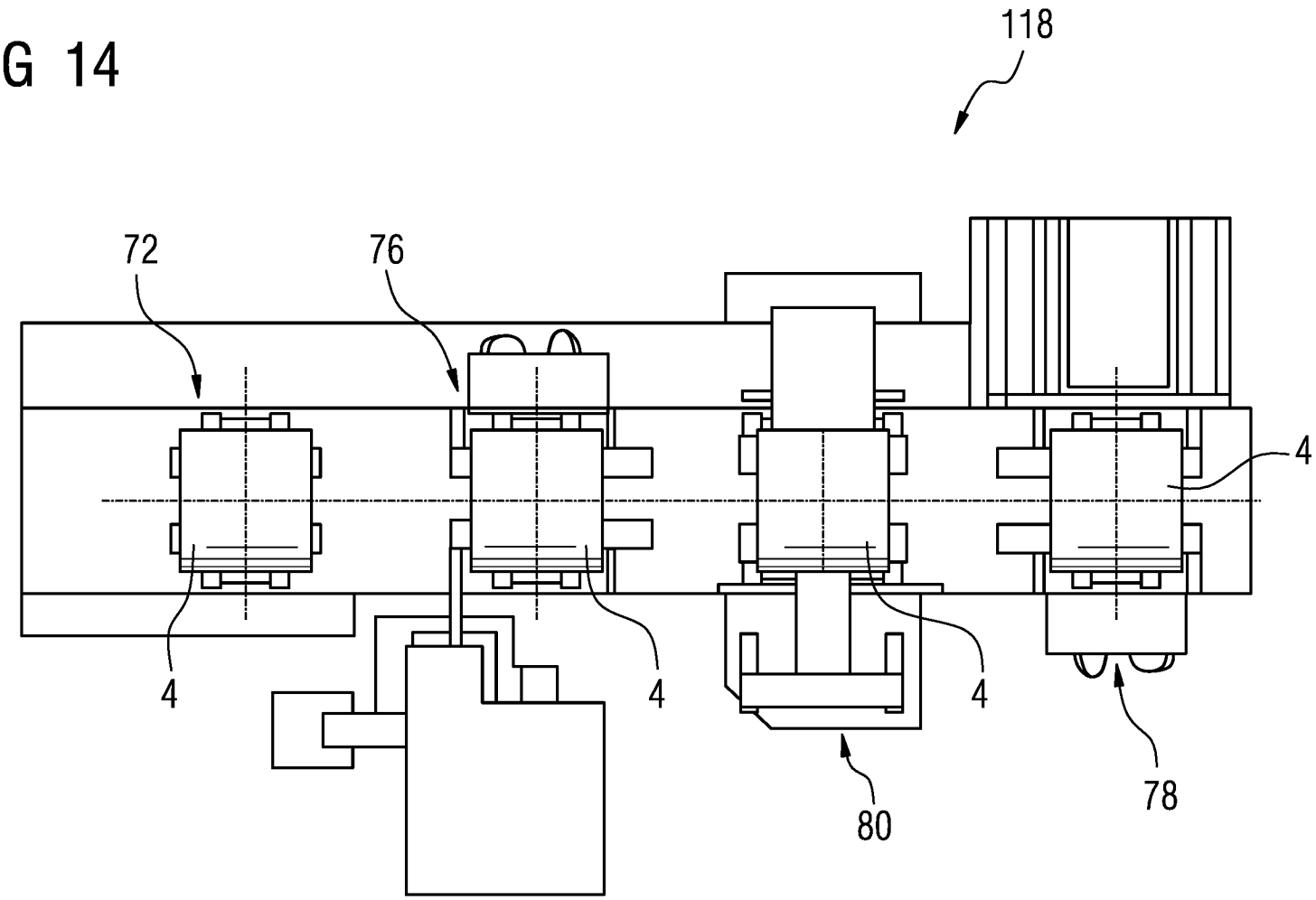
FIG. 14 is a top view of another coil processing system.

FIG. 14 shows a top view of another coil processing system 118, likewise being a coil sampling system.

This coil processing system 118 comprises four coil processing stations 72, 76, 78, 80. In the present exemplary embodiment, the coil processing stations 72, 76, 78, 80 are a delivery station 72, a band removal station 76, a circumference strapping station 80, and a sampling station 78. The individual coil processing stations 72, 76, 78, 80 need not be arranged in the sequence shown in FIG. 14. For example, the band removal station 76 and the circumference strapping station 80 may be interchanged.

Furthermore, the coil processing system 118 comprises a transport device (not shown in FIG. 14), which corresponds in its design to one of the previously described transport devices 2, 50, 56.

With the aid of a transport system (not shown), such as a crane, a coil 4 to be processed in the coil processing system 118 is transported to the delivery station 72 and set down there.

By means of the transport device of the coil processing system 118, the coil 4 is transported according to the manner described above in connection with FIG. 10 from the delivery station 72 in the direction of the sampling station 78, and while optionally en route to the sampling station 78 a strapping band closing the coil 4 is removed in the band removal station 76.

After being sampled in the sampling station 78, the coil 4 is transported by the transport device of the coil processing system 118 in the reverse direction from the sampling station 78 to the strapping station 80, where the coil 4 is strapped.

From the strapping station 80, the coil 4 is transported by the transport device of the coil processing system 118 to the delivery station 72. There, the coil 4 is transported by the transport system out from the coil processing system 118. The delivery station 72 thus serves at the same time as the pick-up point of the coil processing system 118.

In principle, the sampling station 78 can be outfitted with its own band removal device. In such a case, the band removal station 76 of the coil processing system 118 could be basically omitted.

Although the invention has been illustrated and described more closely in detail by the preferred exemplary embodiments, the invention is not limited by the disclosed examples and other variations may be derived from them without leaving the scope of protection of the invention.

LIST OF REFERENCE NUMBERS

2 Transport device
4 Coil
6 Coil transport cart
8 Chassis
10 Coil support
12 Fastening device
14 Wheel

16 Bearing tines
18 Coil axis
20 Longitudinal direction
22 Clamping unit
24 Clamping section
26 Base section
28 Sliding section
30 Drive unit
32 Lifting rod
34 Drive unit
36 Lifting rod
38 Sliding guide
40 Cut-out
42 Coil eye
44 Pressing surface
46 Bottom side
48 Longitudinal center plane
50 Transport device
52 Friction reducing unit
54 Roller
56 Transport device
58 Sliding guide
60 Top side
62 Top side
64 Width
66 Sliding section
68 Sliding guide
70 Coil processing system
72 Delivery station
74 Delivery station
76 Band removal station
78 Sampling station
80 Circumference strapping station
82 Weighing station
84 Eye strapping station
86 Pick-up point
88 Transport device
90 Rail track
92 Coil receiver
94 Band removal device
96 Hold-down device
98 Swivel arm
100 Hold-down roller
102 Hold-down device
104 Hold-down device
106 Hold-down device
108 Severing device
110 Coil receiver
112 Bottom roller
114 Strapping device
116 Coil receiver
118 Coil processing system

The invention claimed is:

1. A coil supporting device for supporting a coil, the coil being wound defining a coil eye which is open longitudinally across the coil, the device comprising:

a coil supporting base having a chassis and having a coil support that has a top side and is configured to be height-adjustable relative to the chassis;

the coil supporting base including a movable fastening device comprising a clamping unit having a top side and configured for pressing the coil that is to be transported against the coil support, the clamping unit being height-adjustable relative to the coil support;

the clamping unit being configured to be able to be at least partially inserted into the coil eye of the coil;

the fastening device being fastened to the coil support or to the chassis of the coil supporting base; and the coil support defining a space, into which the clamping unit can be at least partly lowered such that the top side of the clamping unit is flush with the top side of the coil support.

2. The coil supporting device as claimed in claim 1, configured to be:

the clamping unit comprising a friction reducing unit located and configured to reduce frictional resistance between the coil and the clamping unit during winding and/or unwinding of the coil when the clamping unit is at least partially inserted into the coil eye.

3. The coil supporting device as claimed in claim 2, wherein the friction reducing unit comprises one or more rollers configured to function as friction reducing means.

4. The coil supporting device as claimed in claim 1, wherein the clamping unit includes a rounded pressing surface curved around the coil eye, and the surface is configured and located for pressing against the coil, while the clamping unit is at least partially in the coil eye.

5. The coil supporting device as claimed in claim 1, further comprising:

the coil support comprises bearing tines, on which and located where the coil can be placed; and the bearing tines are beveled toward the longitudinal center plane of the coil support.

6. A coil processing system comprising a first coil processing station and a second coil processing station; and a coil supporting base at each coil processing station;

at least one transport device according to claim 1 configured and operable for transporting a coil from one of the first and second coil processing stations to the other of the first and second coil processing stations.

7. The coil processing system as claimed in claim 6, wherein:

the coil processing system is a coil sampling system, wherein one of the coil processing stations is configured and operable as a sampling station including a severing device configured and operable for severing the coil; and the other of the two coil processing stations is configured and operable as at least one of:

a delivery station for a coil, a pick-up point for a coil;

a weighing station for a coil; and a band removal station for removing a band from a coil; or a strapping station for strapping a coil.

8. The coil processing system of claim 6, wherein the coil supporting base includes a transport device for transporting the coil supporting base and a coil thereon between the first and the second coil processing stations.

9. A method for operating a coil supporting device as claimed in claim 1, comprising:

transporting a coil in a coil processing system from a first coil processing station of the coil processing system to a second coil processing station of the coil processing system by the coil transport device.

10. The method for operating according to claim 9, during the transport of the coil:

laying the coil on a coil support of the transport device;

introducing the clamping unit of the transport device into the coil eye of the coil; and pressing the coil with aid of the clamping unit against the coil support.

11. The transport device of claim 1, wherein the space defined by the coil support comprises a cut-out in the coil support configured to receive the clamping unit lowered into the cut-out.

12. The coil supporting device of claim 1, wherein the space into which the clamping unit can be at least partly lowered is so sized, shaped and located that the space cannot receive the lowering clamping unit while the clamping unit is at least partially into the coil eye.

13. A method for transporting a coil comprising:

transporting a coil, from a first coil processing station to a second coil processing station of a coil processing system, with the aid of a coil supporting device for supporting the coil, the coil being wound defining a coil eye which is open longitudinally across the coil, the coil supporting device including a coil supporting base having a chassis and having a coil support, configured to be height-adjustable relative to the chassis, the coil supporting base including a movable fastening device comprising a clamping unit configured for pressing the coil that is to be transported against the coil support, the clamping unit being height-adjustable relative to the coil support, the clamping unit being configured to be able to be at least partially inserted into the coil eye of the coil, the fastening device being fastened to the coil support or to the chassis of the coil supporting base, and the coil support defining a space, into which the clamping unit can be at least partly lowered;

driving a coil transport cart of the coil supporting device up to the coil that is then situated in/at the first coil processing station and introducing the clamping unit of the transport device into the coil eye of the coil;

lowering the clamping unit that was introduced into the coil eye, the lowering being until the clamping unit presses against the coil;

raising a coil support of the coil supporting device until the coil lies against the raised coil support;

synchronously raising the coil support and the clamping unit when the coil is lying against the coil support and the clamping unit presses against the coil;

with the coil lying against the coil support, transporting by the coil transport cart to the second coil processing station while the coil is pressed by the clamping unit against the coil support; and when the coil has reached the second coil processing station, lowering the coil support and the clamping unit synchronously until the coil lies against a coil receiver of the second coil processing station; then further lowering the coil support, and during the lowering of the coil support, pressing the coil by the clamping unit against the coil receiver of the second coil processing station, or while the coil is located in/at the first coil processing station, removing a hold-down device of the first coil processing station which hold-down device had been pressing against the coil from the coil when the clamping unit presses against the coil, or when the coil has reached the second coil processing station, lifting the clamping unit from the coil when a hold-down device of the second coil processing station presses against the coil.

* * * * *